United States Patent [19]

Daus

[11] Patent Number: 5,014,369

[45] Date of Patent: May 14, 1991

[54] POOL COVER TIE-DOWN

[75] Inventor: John H. Daus, Evansville, Ind.

[73] Assignee: Anchor Industries, Inc., Evansville, Ind.

[21] Appl. No.: 508,124

[22] Filed: Apr. 11, 1990

[51] Int. Cl.[5] ..... E04H 4/00; A44B 1/04

[52] U.S. Cl. ..... 4/503; 4/496; 24/324

[58] Field of Search ..... 4/503, 504, 496, 498, 4/661; 248/499, 500, 508, 509; 24/16 R, 17 R, 324, 300; 220/216, 241, 242, 315

[56] References Cited

U.S. PATENT DOCUMENTS

| | | | |
|---|---|---|---|
| 2,958,872 | 11/1960 | Meyer | 4/503 |
| 3,229,309 | 1/1966 | Knodel | 4/503 |
| 3,264,656 | 8/1966 | Clay et al. | 4/503 |
| 4,916,763 | 4/1990 | Christensen | 4/503 |

*Primary Examiner*—Henry J. Recla
*Assistant Examiner*—Antoine A. Gamarras
*Attorney, Agent, or Firm*—Warren D. Flackbert

[57] ABSTRACT

A tie-down particularly adapted for use in combination with a pool cover which importantly prevents any marring, scratching or damage to the surface of the deck surrounding the pool. The tie-down is generally flat and smooth and made from a tough flexible rubber compound, presenting a keyhole slot at one end and a bifurcated opposite end. Either a hollow threaded member (or fastener) or a selective snap fastening arrangement is presented at the latter. The keyhole slot engages an anchor embedded in the pool deck, where the opposite bifurcated end secures one of a series of grommets disposed along the edge of the pool cover. The invention achieves desired strength and pulling force on the cover.

7 Claims, 1 Drawing Sheet

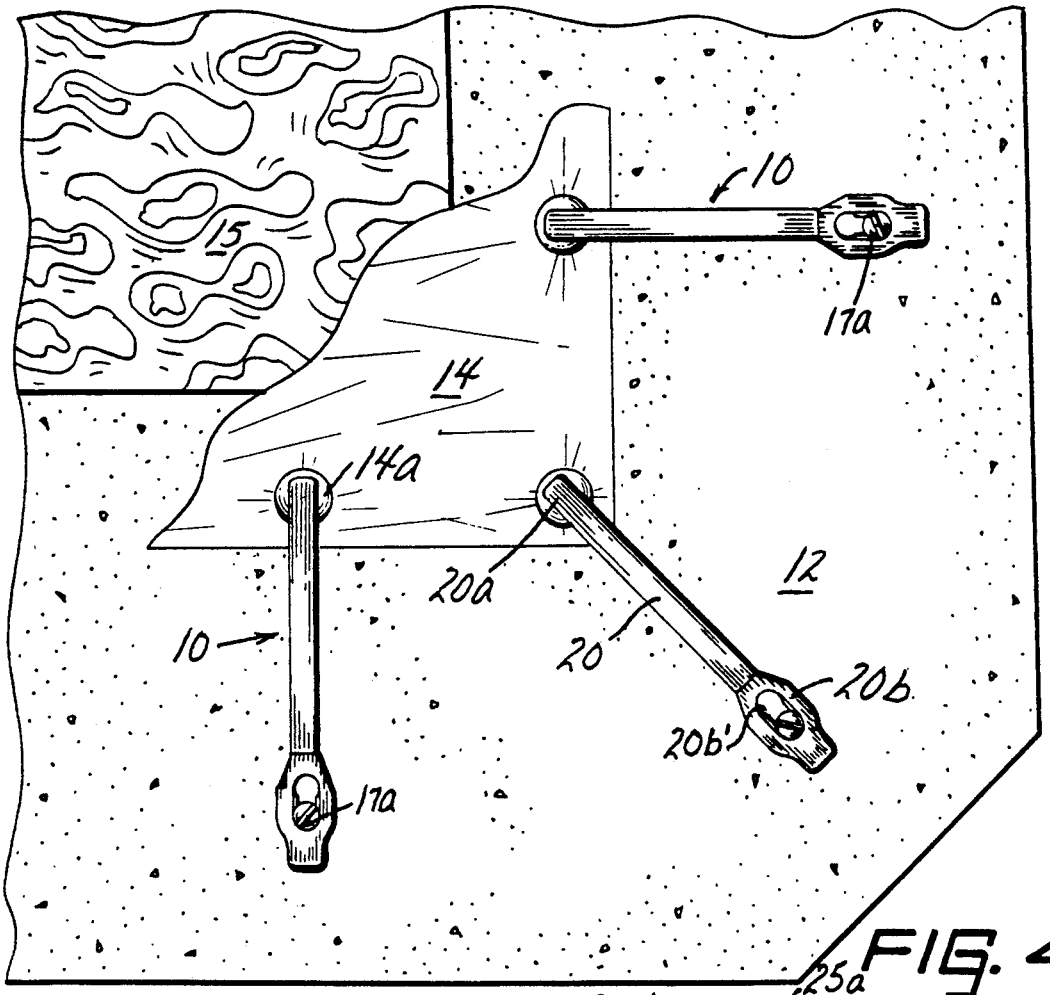
FIG. 4
FIG. 1
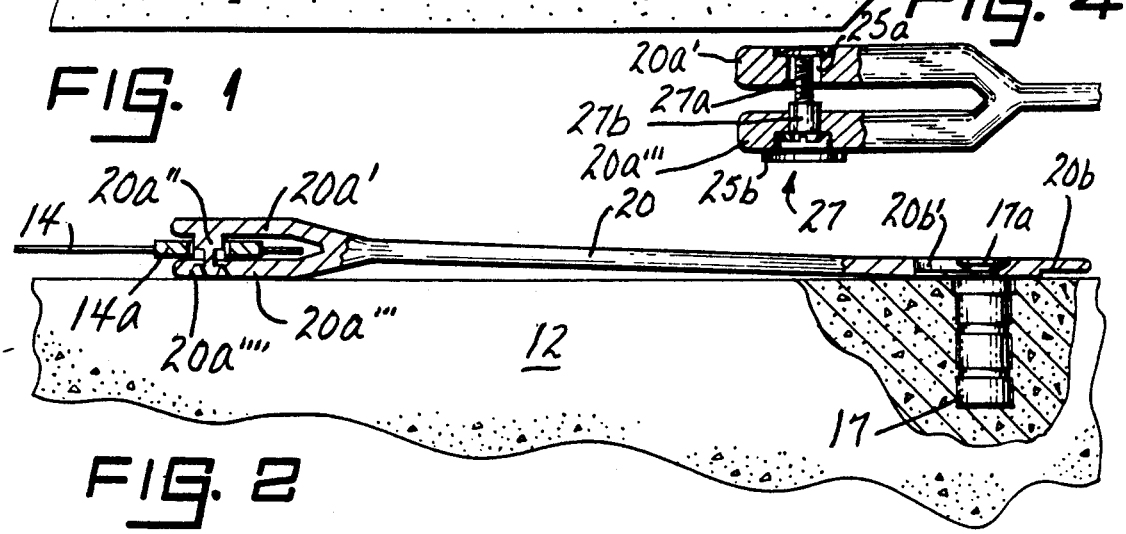
FIG. 2
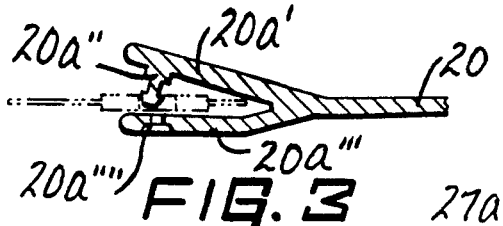
FIG. 3
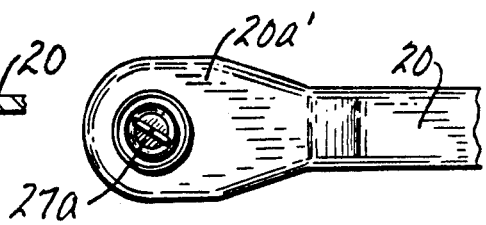
FIG. 5

POOL COVER TIE-DOWN

BACKGROUND OF THE INVENTION

As is known, the popularity of swimming pools is widespread, where, typically, an outside pool is covered during periods of non-use. The covering is employed to prevent accumulation of unwanted debris; for reasons of safety; and, even to prevent heat loss. A primary tie-down arrangement used heretofore mostly employs coil springs disposed at various locations around the pool to tension and secure the cover. A objection to the preceding, however, is the possible damage incurred to the ceramic tile, or like frangible material, ordinarily used for a pool deck because of ease in cleaning and, as well, ornamental purposes.

SUMMARY OF THE INVENTION

The invention presents a pool cover tie-down, made from a flexible, generally elastic, resilient material, such as a heavy duty rubber (compound), which effectively places the cover in tension, when an appropriate number surrounds such, and, at the same time, is positively positioned through a combined anchor-keyhole relationship at one end thereof and, in the alternative, a fastener (or hollow stem threaded member) or a bifurcated snap fit engagement, both with a grommet in the pool cover, at the opposite end. In view of the fabrication of the tie-down from resilient and no-scratch material, any damage to the pool deck is avoided, thereby presenting a significant use feature.

DESCRIPTION OF THE DRAWINGS

A better understanding of the present invention will become more apparent from the following description, taken in conjunction with the accompanying drawing, wherein FIG. 1 is a top plan view showing a form of pool cover tie-down, in a use condition, in accordance with the teachings of the present invention;

FIG. 2 is a view in side elevation, partly in vertical section, detailing the pool cover tie-down of FIG. 1.;

FIG. 3 is an enlarged view in vertical section, partly fragmentary, showing one end of the pool cover tie-down of FIG. 1 prior to cover grommet securement;

FIG. 4 is a view in side elevation, partly in vertical section, showing another form of pool cover tie-down, in a use condition, in accordance with the teachings of the present invention; and, FIG. 5 is a top plan view further detailing the pool cover tie-down of FIG. 4.

For the purposes of promoting an understanding of the principles of the invention, reference will now be made to the embodiments illustrated in the drawing and specific language will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

DESCRIPTION OF PREFERRED EMBODIMENTS

Referring now to the figures, the pool cover tie-down 10 of the invention is shown in a use condition, to-wit, in combination with the top surface of a pool wall or deck 12 and a cover 14 overlying water 15. The pool deck or wall 12 may be in the form of concrete (as shown) or concrete overlaid with decorative material, such as ceramic tile, or the like. The cover 14 is particularly light in weight, mesh or solid, and fabricated from a vinyl or polypropylene fabric, and includes common grommets 14*a* spaced inwardly from the free edges.

The tie-down 10 presented herein is defined by a generally flat and relatively smooth elongated body 20 having end portions 20*a* and 20*b*. In one form, end portion 20*a* is bifurcated and includes an upper portion 20*a'* having a projection 20*a''* thereon and a lower portion 20*a'''* having an opening 20'''' which selectively receives the aforesaid projection 20'' (FIGS. 2 and 3).

The spacing between the upper portion 20*a'* and the lower portion 20*a'''* is such as to receive the thickness of the cover 14 and, as well, the grommet 14*a*, meaning that the tie-down 10 is adapted to receive the grommet 14*a* (again see FIG. 3) and assume final assembly with such grommet 14*a* (again see FIG. 2). In other words, fastening of the tie-down 10 with the pool cover 14 is simply and positively achieved.

FIGS. 4 and 5 disclose another form of tie-down arrangement at end portion 20*a*, to-wit, the same bifurcated relationship of FIGS. 2 and 3, but where, in this instance, openings 25*a* and 25*b*, respectively, extend through the upper portion 20*a'* and the lower portion 20*a'''* and serve to receive a fastener or hollow stem threaded member 27. The latter is more particularly defined by an upper threaded portion 27*a* (with a slot in the top surface thereof) feeding into a lower portion 27*b* presenting an upstanding hollow stem.

In any event, when once positioned so that alignment exists between openings 25*a* and 25*b* and the opening in grommet 14*a* (not shown in FIGS. 4 and 5), tightening of upper threaded portion 27*a*, by rotating action, moves such into positioned fastening engagement with lower portion 27*b*. Thus, the position of end portion 20*a* is established.

As to opposite end portion 20*b* of the tie-down 10, such receives a keyhole opening 20*b'* therein, i.e. one which is larger in the direction of the pool cover 14 and smaller in the opposite direction. In a use condition, a hole is drilled in the pool deck 12 and an anchor 17 inserted therein. The anchor 17 may be retained in the opening through the use of an adhesive (not shown).

In any event, the anchor 17 includes a threaded bolt presenting an unthreaded portion along its upper end, i.e. beneath bolt head 17*a*. When the bolt is unthreaded, the unthreaded portion thereof is received in the keyhole opening 20*b'*. The layout is such that tension is exerted on the tie-down 10 at a use condition and, as well, on the pool cover 14.

In other words, the tie-down 10 extends between the grommet 14*a* on the cover 14 and the raised bolt head 17*a* on the anchor 17, where the keyhole opening 20*b'* assures positive tie-down purposes. Obviously, the anchor 17 should be so positioned, with respect to the length of the tie-down 10 and the size of the cover 14, to assure equal pull on the cover 14 and maintain the weight of the cover 14 equally distributed. Moreover, with the usage of a tough flexible rubber compound for the tie-down 10, strength is provided but, as well, possible damage to the upper surface of the pool wall or deck 12 is precluded and/or minimized.

The pool cover tie-down 10 described hereabove is susceptible to various changes within the spirit of the invention, including, for example, in proportioning; the particular type of grommet employed; the fact that other than a pool cover can be utilized with the tie-down, i.e. a cover for another end purpose; and, the like. Thus, the preceding description should be considered illustrative and not as limiting the scope of the following claims:

I claim:

1. A tie-down arrangement comprising an elongated body made from durable and flexible material, an anchor and a cover presenting grommets along an edge thereof, where said body includes a keyhole slot at one end adapted to be secured to said anchor and a bifurcated opposite end receiving said edge and presenting means adapted to be selectively received in one of said grommets on said cover.

2. The tie-down arrangement of claim 1 where said body is generally flat.

3. The tie-down arrangement of claim 1 where said body is relatively smooth.

4. The tie-down arrangement of claim 1 where said means is a projecting portion on said bifurcated opposite end.

5. The tie-down arrangement of claim 4 where said bifurcated end of said body includes a first part from which said projecting portion extends and a second part, and where said grommet is placed between said first part and said second part.

6. The tie-down arrangement of claim 1 where said means includes first a hollow threaded member in a first part of said bifurcated end and a second threaded member in a second part of said bifurcated end and threadably engaged in said hollow threaded member.

7. The tie-down arrangement of claim 6 where said bifurcated end of said body includes a first opening and a second opening through which portions of said hollow threaded member extend and are retained.

* * * * *